US007168346B2

(12) United States Patent
Lin

(10) Patent No.: US 7,168,346 B2
(45) Date of Patent: Jan. 30, 2007

(54) HAND TOOL HAVING AN ADJUSTABLE HEAD WITH A JOINT LOCK MECHANISM

(75) Inventor: Yu-Cheng Lin, Taichung (TW)

(73) Assignee: Lea Way Hand Tool Corporation (TW)

( * ) Notice: Subject to any disclaimer, the term of this patent is extended or adjusted under 35 U.S.C. 154(b) by 0 days.

(21) Appl. No.: 11/082,465

(22) Filed: Mar. 17, 2005

(65) Prior Publication Data

US 2006/0042425 A1 Mar. 2, 2006

(30) Foreign Application Priority Data

Aug. 31, 2004 (TW) ..... 93213843 U

(51) Int. Cl.
*B24B 23/16* (2006.01)

(52) U.S. Cl. ..... 81/177.9; 81/177.8; 81/177.7

(58) Field of Classification Search ..... 81/177.2, 81/177.7, 177.8, 177.85, 177.9
See application file for complete search history.

(56) References Cited

U.S. PATENT DOCUMENTS 6,216,567 B1 4/2001 Hu
6,557,442 B1 * 5/2003 Owoc ..... 81/177.9
6,857,341 B1 * 2/2005 Cheng ..... 81/177.8
6,957,600 B2 * 10/2005 Hu ..... 81/177.8
2002/0092387 A1 * 7/2002 Lee ..... 81/177.8
2003/0015070 A1 * 1/2003 Chen ..... 81/177.9
2003/0188608 A1 * 10/2003 Hsien ..... 81/177.8
2004/0020331 A1 * 2/2004 Lee ..... 81/177.2
2004/0144217 A1 * 7/2004 Hu ..... 81/177.8
2004/0144218 A1 * 7/2004 Hu ..... 81/177.8
2004/0144219 A1 * 7/2004 Lin ..... 81/177.8
2004/0177731 A1 * 9/2004 Chen ..... 81/177.8
2005/0051004 A1 * 3/2005 Chen ..... 81/177.8
2005/0155468 A1 * 7/2005 Chu ..... 81/177.8

FOREIGN PATENT DOCUMENTS

TW 92204589 3/2003

* cited by examiner

*Primary Examiner*—Joseph J. Hail, III
*Assistant Examiner*—Robert Scruggs
(74) *Attorney, Agent, or Firm*—Ladas and Parry LLP

(57) ABSTRACT

A hand tool having an adjustable head with a joint lock mechanism. The joint lock mechanism comprises a first engaging device, a push button, a second engaging device, a first elastic device and a second elastic device. The push button is formed with a through hole and a first engaging portion. The second engaging device passes through the through hole and is disposed with a second engaging portion. When the first engaging portion engages the second engaging portion, the front end of the first engaging portion abuts the front end of the second engaging portion such that the second engaging device engages the first engaging device and is prevented from moving.

13 Claims, 6 Drawing Sheets

HAND TOOL HAVING AN ADJUSTABLE HEAD WITH A JOINT LOCK MECHANISM

BACKGROUND OF THE INVENTION

1. Field of the Invention

The present invention relates to a hand tool having an adjustable head with a joint lock mechanism, especially a hand tool with a head of adjustable angles and easier, more secured positioning. The present application claims priority based on ROC (Taiwan) Patent Application No. 093213843.

2. Description of the Related Art

Conventional hand tools with an adjustable head, such as those disclosed in U.S. Pat. No. 6,216,567, comprise a head and a handle. The head has a convex portion which can be pivotally coupled to a concave portion of the handle by a screw. A joint lock mechanism comprises a toothed portion formed along the surface of the convex portion, a pin and a push button. The pin is received in a longitudinal hole having a shoulder portion and extending along the length of the handle. A toothed portion is formed at one end of the pin opposite to the toothed portion of the convex portion while the other end has an extended portion. A spring encircles the extended portion of the pin and abuts against a shoulder portion of the longitudinal hole at the other end to provide the pin with a forward force such that the toothed portion of the pin engages the toothed portion of the convex portion to lock and position the head of the wrench. The push button is received in a hole having a shoulder portion and being perpendicular to the longitudinal hole. One end of the push button abuts against a spring received in the shoulder portion of the hole and has an extended portion. One side of the extended portion of the push button is formed with a slot keeping in contact with the extended portion of the pin. The depth of the slot is gradually deepened towards the push button such that a gap is formed between the push button and the extended portion of the pin when the push button is pressed down. Therefore, the head of the wrench is rotatable with respect to the handle and pushes the pin such that the angle of the wrench can be adjusted. However, this kind of wrench cannot sustain high torque due to the configuration of the slots in the extended portion of the push button and the extended portion of the pin. In addition, since the extended portion of the pin is slidable with respect to the slot of the push button, it is not possible to lock the head effectively. Moreover, the extended portion of the push button and the extended portion of the pin may be worn out or fractured after use for a long period, which subsequently causes inconvenience when they are in use and reduces the life time of the wrench.

TW569860 has disclosed a wrench comprising a head and a handle. Again, the head has a convex portion which can be pivotally coupled to a concave portion of the handle by a screw. A toothed portion is formed along the surface of the convex portion to engage a ball received in a hole formed in the concave portion of the handle such that the head can be positioned at a certain angle. A push button is received in a hole formed radially in the handle and a spring is disposed in the bottom of the hole and abuts against the bottom end of the push button. A stepped groove is formed at the side of the push button such that a cap can be formed between the push button and the ball when the push button is pressed down and the head can push the ball and rotate with respect to the handle to adjust the angle of the wrench. Again, this kind of wrench cannot sustain high torque. In addition, since the teethed portion of the convex portion is of a sharp arc shape, it is likely that the teethed portion may be fractured due to high torque which renders the wrench unusable.

From the above, it is necessary for the industry to provide a hand tool having an adjustable head with a joint lock mechanism, which offers convenient and secured angle adjustment and positioning and can overcome the defects mentioned in the prior art.

SUMMARY OF THE INVENTION

It is an object of the present invention to provide a hand tool having an adjustable head with a joint lock mechanism, with easier and more secure positioning.

According to the present invention, a hand tool is provided having an adjustable head with a joint lock mechanism. The joint lock mechanism is disposed between the rear end of the head and the front end of the handle. A first aperture is formed at the front end of the handle and longitudinally extends along the length thereof, and a second aperture is formed perpendicularly intersecting the first aperture. The joint lock mechanism further comprises:

- a first engaging device disposed at the rear end of the head;
- a second engaging device received in the first aperture, the second engaging device having a front end and a rear end;
- a push button received in the second aperture; and
- a first elastic device received in the first aperture such that the second engaging device is provided with a forward force to engage the front end of the second engaging device with the first engaging device;

characterised in that:

- the push button is formed with a through hole and provided with a first engaging portion being disposed beneath the through hole; the second engaging device passes through the push button and abuts against the first elastic device; the second engaging device is disposed with a second engaging portion and a second elastic device is disposed at the bottom of the push button such that the push button is provided with an upward force to engage the first engaging portion with the second engaging portion.

Other objects, advantages and novel features of the present invention will be drawn from the following detailed description of preferred embodiments of the present invention when taken in conjunction with the accompanying drawings.

DESCRIPTIONS OF THE DRAWINGS

DETAILED DESCRIPTION OF THE INVENTION

Figure 1:
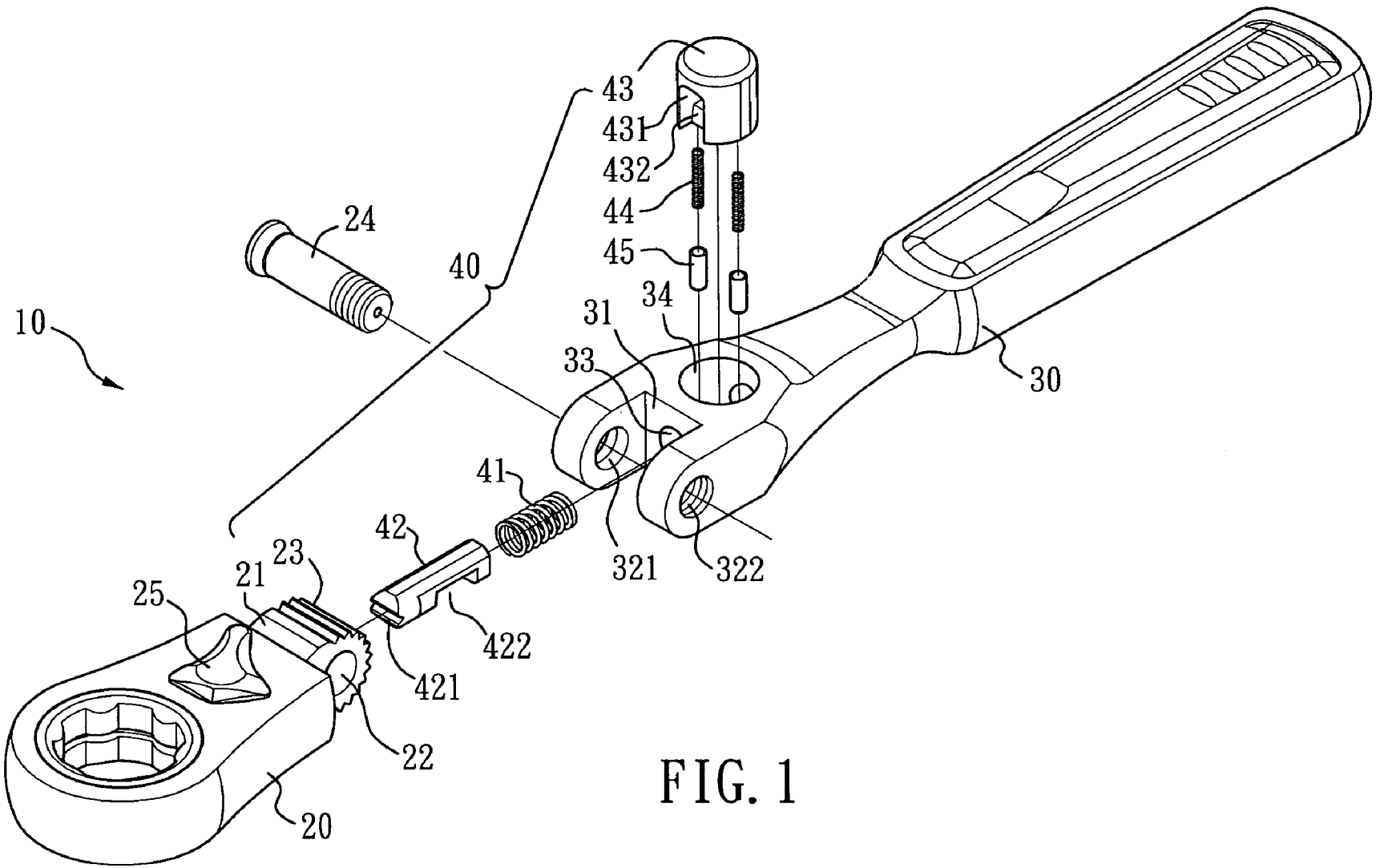
FIG. 1 illustrates an exploded view of a handle tool having an adjustable head with a joint lock mechanism according to the present invention.
Figure 2:
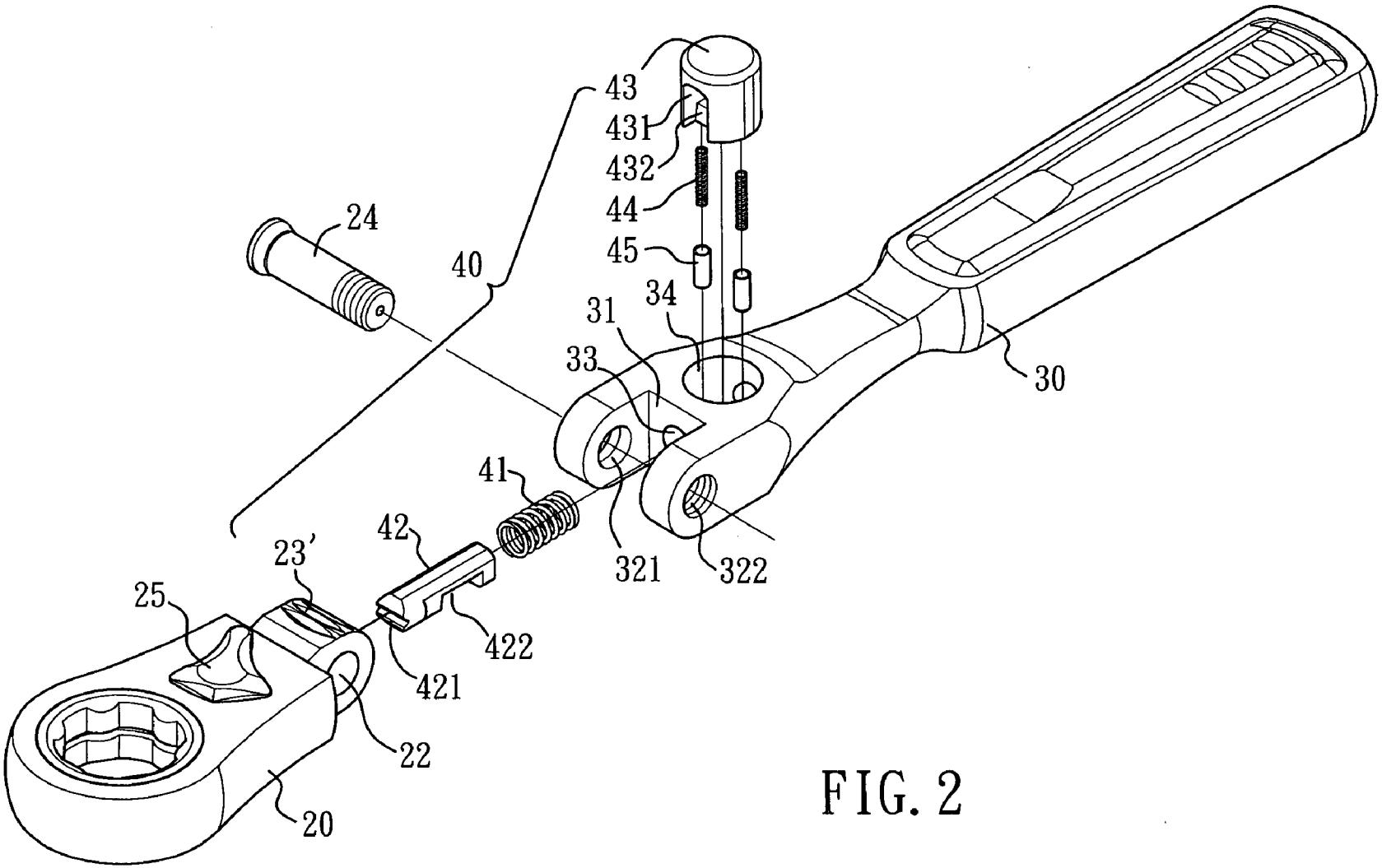
FIG. 2 illustrates an exploded view of the other embodiment according to the present invention, where a convex portion of the head is formed with slots.
Figure 3:
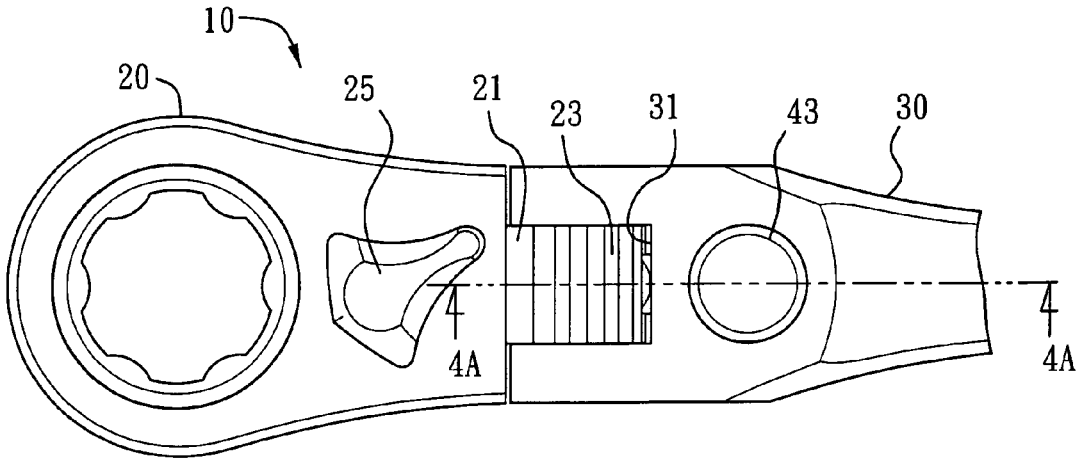
FIG. 3 illustrates a locally enlarged plan view thereof.

FIGS. 1 and 2 illustrate an exploded view of a handle tool having an adjustable head with a joint lock mechanism according to the present invention. A wrench 10 comprises a head 20, a handle 30 and a joint lock mechanism 40. A convex portion 21 is formed at a rear end of the head 20 and a through hole 22 is formed through the convex portion 21. A concave portion 31 is formed at a front end of the handle 30. A through hole 321 and a threaded hole 322 are formed at opposite sides thereof to receive a screw 24 or other suitable fastening device for pivotally coupling the head 20 to the handle 30 such that the head 20 is pivotally coupled with respect to the screw 24 while the handle is fixedly coupled with respect to the screw 24. Regarding the configuration between the screw 24, the through hole 321 and the threaded hole 322, please refer to TW566274 for more details. A first aperture 33 is formed at the front end of the handle 30 and substantially extends along the length thereof, and a second aperture 34 is formed at one side of the front end thereof and perpendicularly intersects the first aperture 33.

Figure 4A:
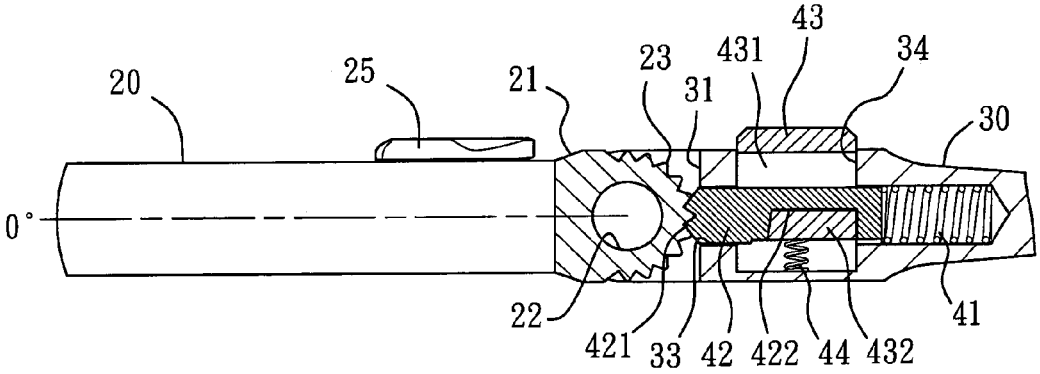
FIG. 4A illustrates a cross-sectional view therof along line 4A—4A in FIG. 3 showing a push button in an unlocked state and the head inclining 0° with respect to a handle.

A joint lock mechanism 40 comprises a first engaging device disposed at the rear end of the head 20, a second engaging device received in the first aperture 33 formed at the front end of the handle 30, a first elastic device and a push button 43. Preferably, the first engaging device can be a plurality of teeth 23 (referring to FIG. 1) or slots 23' (referring to FIG. 2) formed equidistantly along the surface of the convex portion 21 and the teeth 23 or the slots 23' preferably extend along the axis of the through hole 22. In general, the convex portion 21 can include a surface of an arc of 180° or of any other suitable shape. In the preferred embodiments, ten teeth or slots are formed so that the angle between two adjacent teeth or slots is 18°. Preferably, the second engaging device is a pin 42 formed with a double-toothed engaging portion 421 at the front thereof and the first elastic device is a first spring 41. As illustrated in FIG. 4A, the first spring 41 is received in the first aperture 33 abutting against a bottom end thereof and provides the pin 42 with a forward force such that the engaging portion 421 of the pin 42 can engage any of the teeth 23 or slots 23'.

Figure 4B:
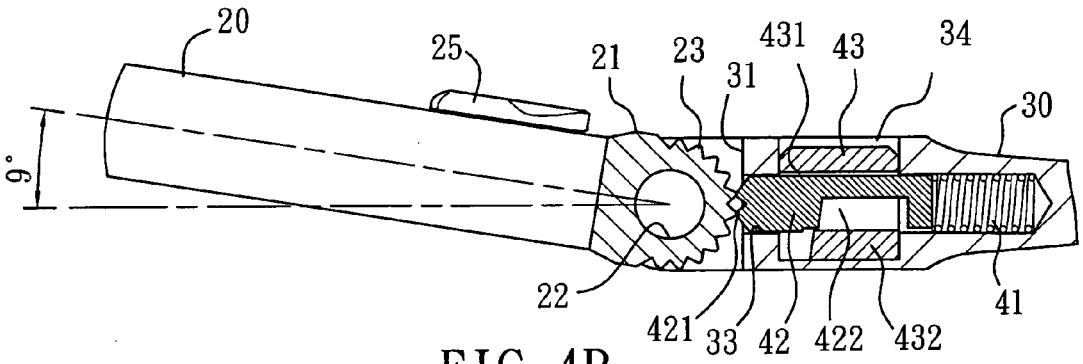
FIG. 4B illustrates a cross-sectional view thereof along line 4A—4A in FIG. 3 showing the push button pressed to an unlocked state and the head inclining 9° with respect to the handle.
Figure 5:
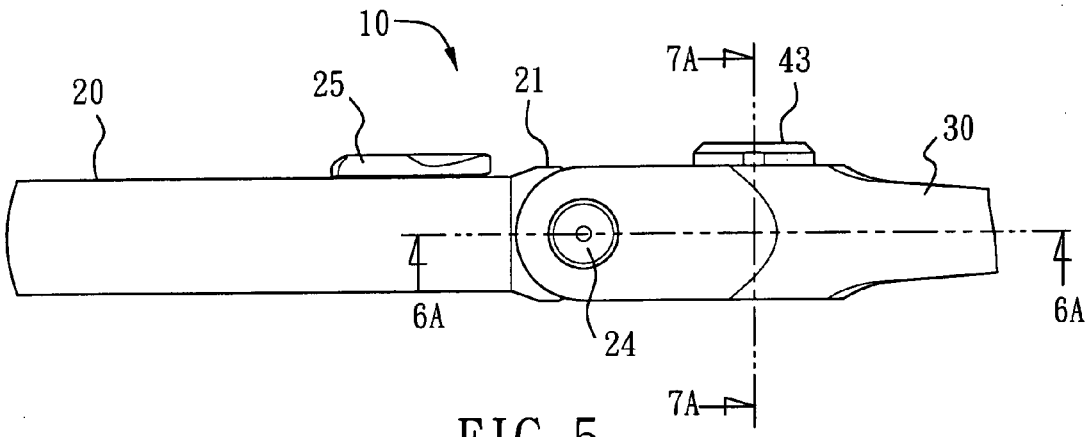
FIG. 5 illustrates a locally enlarged side view thereof.
Figure 6A:
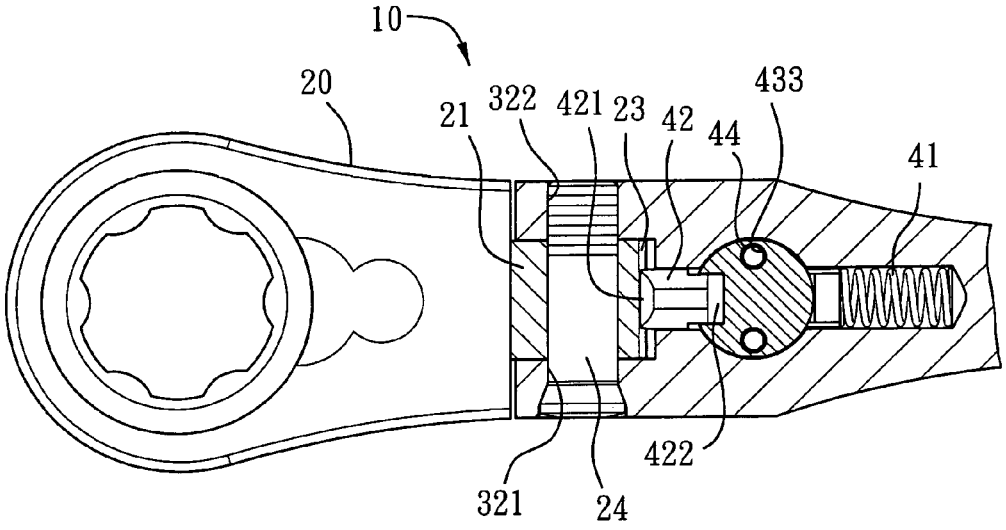
FIG. 6A illustrates a cross-sectional view thereof along line 6A—6A in FIG. 5 showing the push button in an locked state.
Figure 6B:
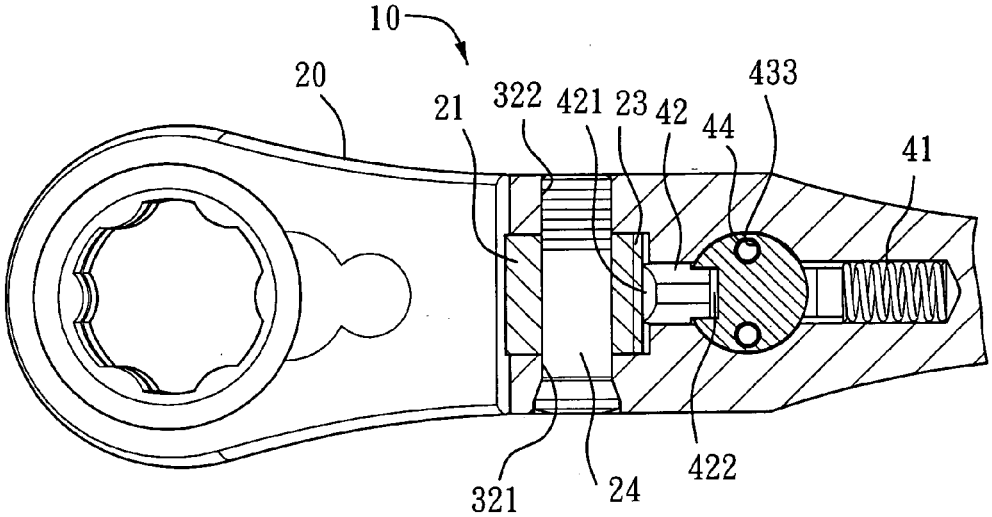
FIG. 6B illustrates a cross-sectional view thereof along line 6A—6A in FIG. 5 showing the push button pressed to an unlocked state and the head inclining an angle with respect to the handle.
Figure 7A:
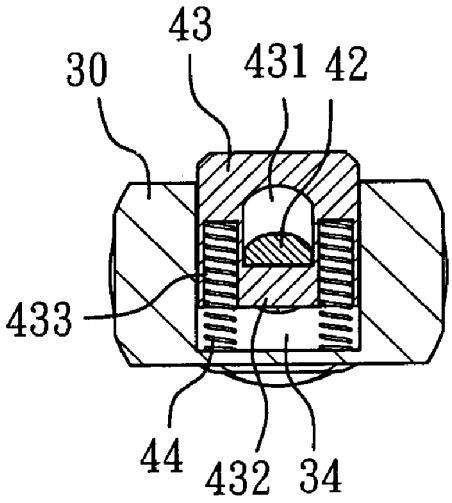
FIG. 7A illustrates a cross-sectional view thereof along line 7A—7A in FIG. 5 showing the push button in an locked state.
Figure 7B:
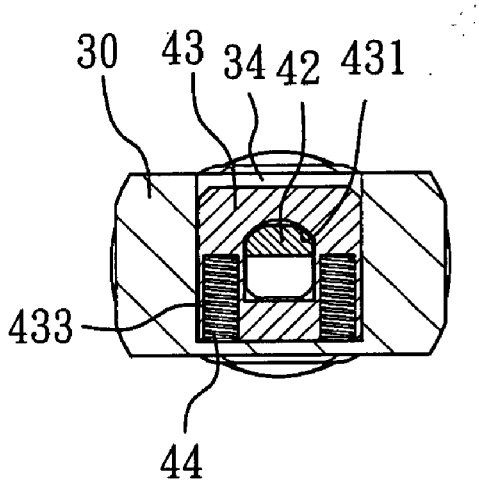
FIG. 7B illustrates a cross-sectional view thereof along line 7A—7A in FIG. 5 showing the push button pressed to an unlocked state.

Further, a push button 43 is formed with a through hole 431 and a first engaging portion 432 is disposed beneath the through hole 431. The pin 42 passes through the through hole 431 of the push button 43 and abuts against the first spring 41. The pin 42 is disposed with a second engaging portion comprising a slot 422 formed at the bottom thereof. A second elastic device is disposed at the bottom of the push button 43 such that the push button 43 is provided with an upward force to engage the front end of the first engaging portion 432 with the slot 422. Preferably, the second elastic device comprises two second springs 44. As illustrated in FIGS. 6A and 7A, two apertures 433 are formed at the bottom of the push button 43 to receive the respective second springs 44 between the push button 43 and the bottom end of the second aperture 34. Referring to FIGS. 1 and 2, the second elastic device can further comprise two hollow pins 45 to hold the respective second springs 44 and to guide and position the second springs 44 to the respective apertures 433. Preferably, the front end of first engaging portion 432 of the push button 43 is formed with an inclined surface (referring to FIG. 4A), and a surface of the slot 422 opposite the reclining surface of the first engaging portion 432 is also formed with an inclined surface so as to enhance tighter engagement between the pin 42 and the push button 43 and to calibrate the matching error during processing. When the push button 43 is pressed down, the slot 422 of the pin 42 can disengage the first engaging portion 432 so the pin 42 can move along the first aperture 33 (referring to FIG. 4B) and the first spring 41 is biased. In addition, the surface of the push button 43 can be formed with an anti-slip pattern thereon or preferably with a pattern consisting of a word "LOCK", a side-view mark of the head and a double arrow crossing the side-view mark (referring to FIG. 8). Additionally, the head 20 can further comprise a control knob 25 to control the operating direction of the wrench 10.

Figure 8:
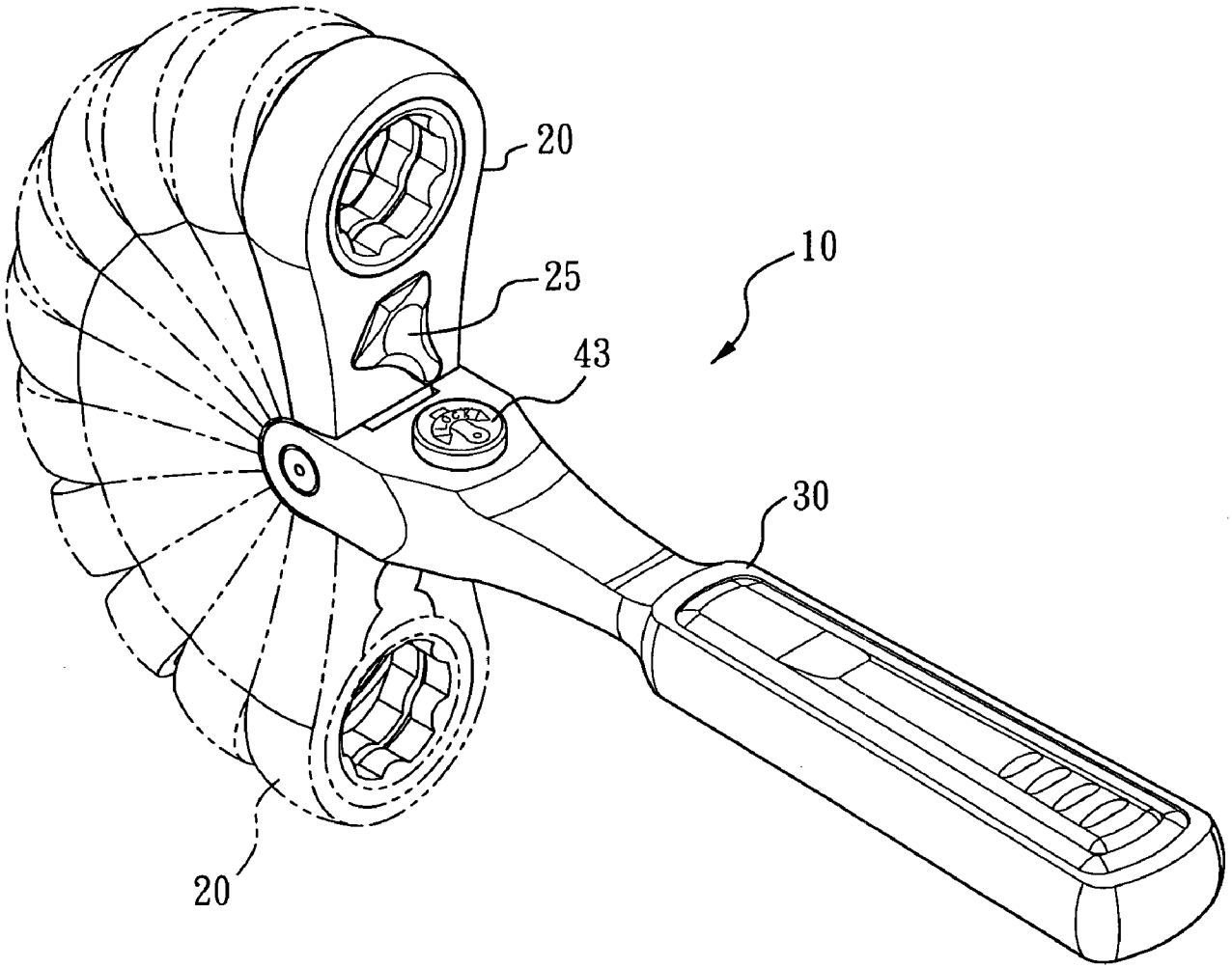
FIG. 8 illustrates the head rotating at multiple angles and a pattern formed on the push button.

FIGS. 3 to 7B illustrate locally enlarged plan, side and cross-sectional views, respectively. From FIGS. 4A and 7A, it can be seen that when the push button 43 is not pressed, two second springs 44 bias against the push button 43 so the slot 422 of the pin 42 engages the first engaging portion 432. Since the front end of the first engaging portion 432 abuts the front end of the slot 422, the pin 42 is prevented from moving backwards along the first aperture 33, and the head 20 is thus locked. When the push button 43 is pressed down, since the front end of slot 422 of the pin 42 disengage the first engaging portion 432, the two second springs 44 are also biased (referring to FIG. 7B) and therefore the head 20 is unlocked. At the same time as the head 20 rotates pivotally with respect to the handle (referring to FIG. 4B) although the teeth 23 still maintain contact with the engaging portion 42, the teeth 23 disengage the engaging portion 421 so that the teeth 23 push the pin 42 backwards with the tip thereof. As illustrated in FIGS. 4B and 6B, when an external force drives the head 20 to a certain angle, the head 20 can be bent and positioned to a predetermined angle. FIG. 8 illustrates the head rotating at multiple angles with respect to the handle 30.

From the above descriptions, it is apparent that the present invention provides a hand tool having an adjustable head with a joint lock mechanism and has easier and more secured positioning over the prior art. While the invention has been described in terms of several preferred embodiments, those skilled in the art will recognise that the invention can still be practiced with modifications, within the spirit and scope of the appended claims.

What is claimed is:

1. A hand tool having an adjustable head with a joint lock mechanism comprising:

a head having a rear end with a convex pivotal portion;

a handle having a front end with a hollow cavity receiving said convex pivotal portion and pivotally coupled to the convex pivotal portion, the handle having a first aperture longitudinally extending from at the front end thereof, and a second aperture perpendicularly intersecting the first aperture; and a fastening device disposed through the convex pivotal portion and the device is hollow cavity to be pivotally coupled to the convex pivotal portion while being fixedly coupled to the handle; and the joint lock mechanism being disposed between the rear end of the head and the front end of the handle, the joint lock mechanism comprising:

a first engaging device disposed at the convex pivotal portion;

a push button received in the second aperture and formed with a through hole, the push button being provided with a first engaging portion disposed beneath the through hole, the first engaging portion having a front end and a rear end;

a second engaging device received in said first aperture, the second engaging device having a front end, a rear end, an engaging portion disposed at the front end thereof and a second engaging portion disposed between the front and the rear ends thereof; said second engaging device passing through the through hole of the push button;

a first elastic device received in the first aperture and abutting the rear end of the second engaging device such that the second engaging device is provided with a forward force to engage the engaging portion of the front end of the second engaging device with the first engaging device;

a second elastic device disposed at the bottom of the push button such that the push button is provided with an upward force to engage the first engaging portion of the push button with the second engaging portion of the second engaging device such that;

when the first engaging portion engages the second engaging portion, the front end of the first engaging portion abuts against the front end of the second engaging portion such that the second engaging device engages the first engaging device and is prevented from moving backwards along the first aperture and when the push button is pressed down, the front end of the second engaging portion disengages the front end of the first engaging portion; the head then being pivotally rotatable with respect to the handle, the first engaging device starts to disengage the second engaging device and pushes the second engaging device backwards along the first aperture with a tip of the first engaging device while still maintaining contact with the second engaging device, and the first engaging device re-engages the second engaging device after rotating at a predetermined angle.

2. The hand tool according to claim 1, wherein the convex pivotal portion has a surface of arc shape.

3. The hand tool according to claim 1, wherein the engaging portion of the second engaging device has a double tooth configuration.

4. The hand tool according to claim 1, wherein the second elastic device comprises two second springs and each of the two second springs is received in a respective aperture formed at the bottom of the push button.

5. The hand tool according to claim 4, wherein the second elastic device further comprises two hollow pins to hold the respective second springs and to guide and position the second springs to the respective apertures.

6. The hand tool according to claim 1, wherein the front end of first engaging portion of the push button is formed with an inclined surface and the front end of the second engaging portion is formed with an inclined surface to match the front end of first engaging portion.

7. The hand tool according to claim 1, wherein the first engaging device has a plurality of teeth formed equidistantly along the surface of the convex pivotal portion, and the engaging portion of the second engaging device 15 engages one of the plurality of teeth.

8. The hand tool according to claim 1, wherein the first engaging device has a plurality of slots formed equidistantly along the surface of the convex pivotal portion, and the engaging portion of the second engaging device engages one of the plurality of slots.

9. The hand tool according to claim 1, wherein the push button has a surface formed with an anti-slip pattern.

10. The hand tool according to claim 1, wherein the push button has a surface formed with a pattern consisting of a word "LOCK", a sideview mark of the head and a double arrow crossing the side-view mark.

11. The hand tool according to claim 1, wherein the head further comprises a control knob to control the operating direction of the hand tool.

12. The hand tool according to claim 1, wherein the first engaging device hits a plurality of teeth formed equidistantly along the surface of the convex pivotal portion, and the engaging portion of the second engaging device engages one of the plurality of teeth.

13. The hand tool according to claim 1, wherein the first engaging device has a plurality of slots formed equidistantly along the surface of the convex pivotal portion, and the engaging portion of the second engaging device engages one of the plurality of slots.

* * * * *